US006166712A

United States Patent [19]

Hoffman et al.

[11] Patent Number: 6,166,712

[45] Date of Patent: Dec. 26, 2000

[54] HIGH-PERSISTENCE DISPLAY CIRCUIT AND METHOD TO THEREFOR

[75] Inventors: Steven Mark Hoffman, Gurnee; Timothy Mark Garton, Cary; Dawn Marie Galecki, Barrington, all of Ill.

[73] Assignee: Motorola, Inc., Schaumburg, Ill.

[21] Appl. No.: 08/086,498

[22] Filed: Jul. 1, 1993

[51] Int. Cl.[7] ..... G09G 3/36

[52] U.S. Cl. ..... 345/87; 345/123

[58] Field of Search ..... 345/121, 123, 345/124, 125, 87, 90, 100, 31, 38, 56; 340/825.44

[56] References Cited

U.S. PATENT DOCUMENTS

| | | | |
|---|---|---|---|
| 3,972,040 | 7/1976 | Hilsum et al. | 345/76 |
| 4,382,256 | 5/1983 | Nagata | 340/825.44 |
| 4,646,081 | 2/1987 | Tsunoda | 345/124 |
| 4,694,406 | 9/1987 | Shibui et al. | 345/123 |
| 4,744,046 | 5/1988 | Foster | 345/123 |

*Primary Examiner*—Chanh Nguyen

*Attorney, Agent, or Firm*—Robert H. Kelly; Randall S. Vaas; Michael C. Soldner

[57] ABSTRACT

A display circuit, and associated method, including a high-persistence display element, such as a liquid crystal display device, which visually displays sequences of informational image frames while minimizing interference between successive ones of the frames. A sequence of informational image frames are displayed upon the display element, thereby to generate a visual signal which appears to scroll across the display element. Blank image frames are interspersed between successive ones of the informational image frames to reduce thereby interference between successive ones of the informational image frames.

11 Claims, 3 Drawing Sheets

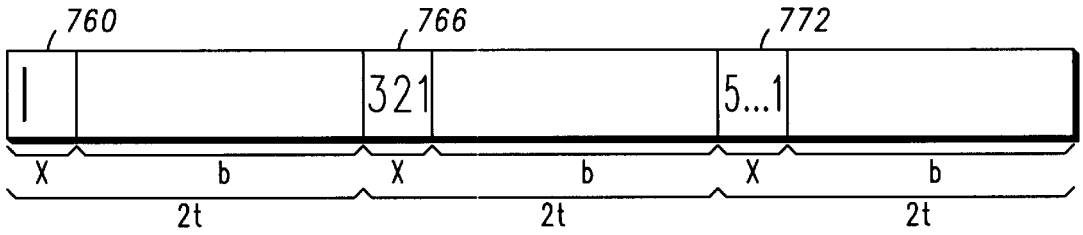
FIG.9
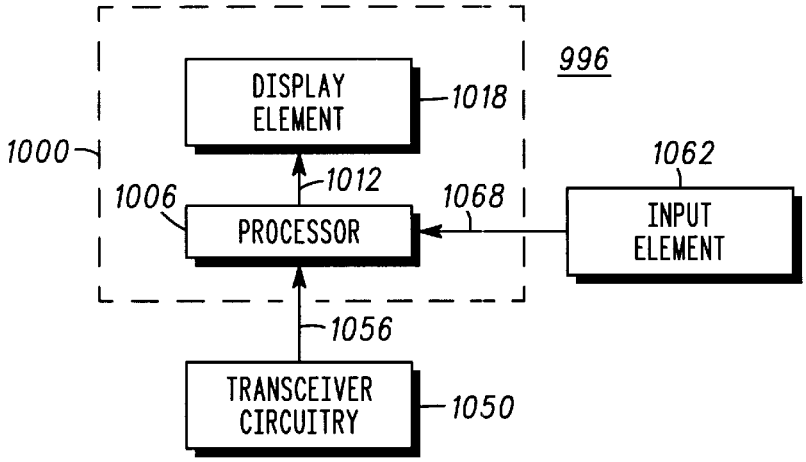
FIG.11
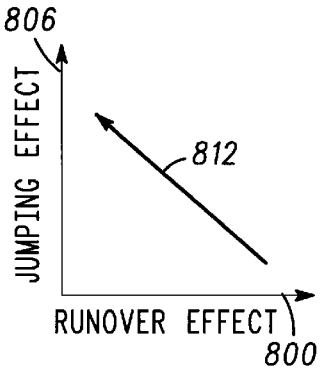
FIG.10
FIG.12
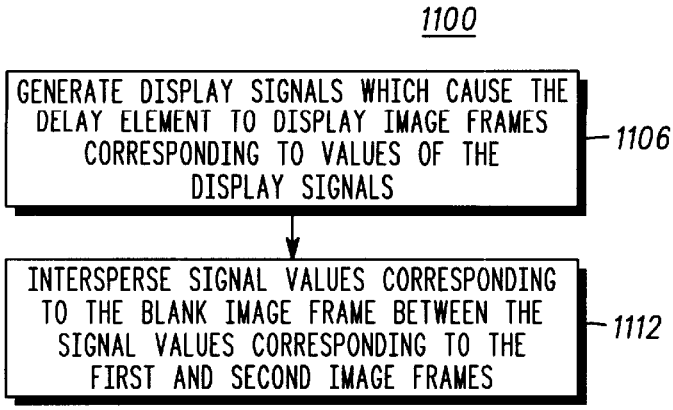

HIGH-PERSISTENCE DISPLAY CIRCUIT AND METHOD TO THEREFOR

BACKGROUND OF THE INVENTION

The present invention relates generally to high-persistence display circuit elements and, more particularly, to a circuit, and associated method, which minimizes interference caused by slow image decay rates characteristic of such high-persistence display elements.

Many electronic devices include, as portions thereof, visual display elements which permit the visual display of information upon display screens thereof. The information displayed by such display elements may include, for example, information generated during operation of the electronic devices and information indicative of operation of the electronic devices. Because the information is displayed by the visual display elements in visual form, viewers of such elements are able to discern quickly and readily the information display thereupon. Examples of visual display elements include indicating lights, light emitting diodes, and liquid crystal displays.

Advancements in the field of electronics has permitted miniaturization of the electronic circuitry comprising electronic devices as well as permitting the introduction of an ever-increasing array of new types of electronic devices. Radio communication devices, such as radio telephones operative in a cellular communication system, are examples of electronic devices comprised of electronic circuitry which have been increasingly miniaturized.

Concomitant with the reduction in the physical dimensions of the electronic circuitry of the electronic devices has been a similar reduction in the physical dimensions of the housings, and other structure of such electronic devices. As the resultant electronic devices are of increasingly smaller physical dimensions, visual display elements forming portions of such electronic devices must also be of increasingly smaller physical dimensions.

However, the visual display elements must be large enough to permit visual display of information in a form permitting convenient viewing thereof by viewers of such displays.

Because of such reduced physical dimensions permitted of the visual display elements of the electronic devices, and because the size of the visual display elements must remain large enough to permit viewers convenient viewing of the information displayed thereupon, an increasing number of instances occur in which the display devices are of physical dimensions which do not permit the entire amount of information which is desired to be displayed upon the display element to be displayed thereupon at any particular instance.

When the information to be displayed is comprised of alphanumeric information, the information desired to be displayed upon the display elements may be caused to be scrolled upon the display screens of the display elements in manners analogous to the display of stock market information on a stock market ticker-tape.

While information displayed upon a display element in such a manner appears to be scrolled upon the display screen of the display element, such an effect is actually created by sequentially displaying upon the display screen of the display element a plurality of discrete image frames. In a manner quite analogous to the manner in which individual frames of a movie reel, when displayed sequentially at a rapid display rate, appear to generate a single, moving picture, the alphanumeric display is caused to appear to scroll across the display element.

As noted briefly hereinabove, a liquid crystal display device is operative to form a visual display element. Use of a liquid crystal display device is of particular advantage as a liquid crystal display device requires little operative power to generate a visual display. When an electronic device is powered by a portable power supply, minimization of amounts of power required to operate the device is normally desired. Accordingly, use of a liquid crystal display device as a visual display element when power consumption of a device is to be minimized oftentimes occurs.

A visual display is generated upon a liquid crystal display device by applying low voltage signals to portions thereof. By applying a low voltage signal to various portions of the liquid crystal display device, the polarity of the affected portions of the device is altered. Changes in the polarity of the affected portions of the device affect the reflectivity and transmissivity characteristics, and, hence, thereby alter the visual characteristics, of the affected portions of the device. By selectively applying voltages to desired portions of the device, thereby to alter the visual characteristics of the desired portions of the device, alphanumeric symbols are formed.

However, upon termination of application of the voltages to the selected portions of the liquid crystal display device, the visual characteristics of the affected portions of the device do not instantaneously change. Rather, an image decay rate is associated with the affected portions of the device. That is to say, the visual characteristics of the device are altered only gradually upon termination of application of the voltages thereto. Only after a time period, related to the image decay rate, are the visual characteristics of the device, previously altered by application of the voltages thereto, no longer visible.

Other constructions of display elements similarly exhibit such characteristics. Display devices exhibiting such characteristics are sometimes referred to as slow-decay displays or high-persistence displays. A liquid crystal display device, or other super-twist display device, is one such example of a slow-decay display or high-persistence display.

When application of voltages associated with a first image frame displayed by the liquid crystal display device is terminated, and voltages associated with a subsequent image frame are applied to the device prior to disappearance of the previously generated image frame, the previously-generated image frame interferes with the visual appearance of the subsequently generated image frame. Such interference is also sometimes referred to as image runover or, more simply, runover. Such interference degrades the quality of the image scrolled upon the display device.

What is needed, therefore, is an improved apparatus, and associated method, which minimizes interference between sequentially-generated image frames displayed upon a high-persistence display device.

A portable radiotelephone utilized in a cellular communication system is one type of electronic device which sometimes includes a liquid crystal display device. The problems associated with the image decay rate of a liquid crystal display is similarly exhibited in a liquid crystal display device forming a portion of the radiotelephone.

What is further needed, therefore, is a display circuit, and a radiotelephone including such, which minimizes interference between sequentially generated image frames which are displayed by the display circuit.

SUMMARY OF THE INVENTION

The present invention, accordingly, advantageously provides apparatus and method which overcomes the limitations of the existing art.

The present invention further advantageously provides a display circuit for visually displaying sequences of informational image frames.

The present invention yet further advantageously provides a high-persistence display circuit, and associated method, which minimizes problems associated with existing such display circuits.

Further advantages and features of the present invention will become more evident upon reading the following detailed description of the preferred embodiments.

In accordance with the present invention, a display circuit, and associated method, for visually displaying a sequence of at least two informational image frames is disclosed. The display circuit comprises a display element having a display screen operative to display the informational image frames thereupon. A display signal generator is coupled to the display element and is operative to generate display signals which cause the display element to display upon the display screen thereof informational image frames corresponding to values of the display signals. The display signals are of signal values including at least signal values corresponding to a first of the at least two informational image frames, a second of the at least two informational image frames, and a blank image frame. The values corresponding to the blank image frame are interspersed between the values corresponding to the first and second informational image frames and are generated for a time period to reduce interference on the display screen of the first informational image frame upon the second informational image frame.

BRIEF DESCRIPTION OF THE DRAWINGS

The present invention will be better understood when read in light of the accompanying drawings in which:

FIG. 9 is a representation, similar to those of FIGS. 7 and 8, but of three adjacently-positioned image frames generated during operation of a further preferred embodiment of the present invention;

FIG. 10 is a graphical representation illustrating the relationship between interference between two adjacently-positioned image frames and the jumping effect associated with the resultant image displayed upon the display element of the display circuit of FIG. 1;

FIG. 11 is a block diagram of a radio telephone which includes as a portion thereof, the display circuit of FIG. 1;

FIG. 12 is a flow diagram listing the method steps of the method of a preferred embodiment of the present invention.

DESCRIPTION OF A PREFERRED EMBODIMENTS

Figure 1:
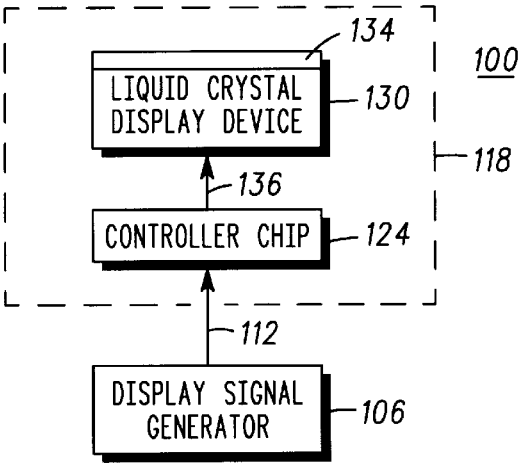
FIG. 1 is a block diagram of a display circuit of a preferred embodiment of the present invention.

Turning first to the block diagram of FIG. 1, a display circuit, referred to generally by reference numeral 100, of a preferred embodiment of the present invention is shown. Display circuit 100 is operative to display information visually, thereby to permit a user of display circuit 100 to ascertain visually such information.

In the preferred embodiment, display circuit 100 is comprised display signal generator 106, here preferably processor circuitry having algorithms executable therein, which is operable to generate display signals on line 112.

Display circuit 100 further comprises display element 118, represented by the rectangle shown in dash which encompasses controller chip 124 and liquid crystal display device 130. Controller chip 124 is coupled to receive the display signals to be displayed on line 112 by display signal generator 106 and is operative to generate signals on line 136 which control operation of display device 130.

As mentioned previously, the visual characteristics of portions of a liquid crystal display device, such as device 130 of display circuit 100 of FIG. 1, are altered responsive to application of voltage signals thereto. Controller chip 124 is operative to generate signals on line 136 responsive to signals applied thereto on line 112 by display signal generator 106. The signals generated by controller 124 cause the visual characteristics of portions of liquid crystal display device 130 to be altered. By altering the portions of display device 130 to which the voltages are applied, the images displayed by display device 130 may be altered. Block 134 positioned at a top portion of liquid crystal display device 130 is representative of a display screen which forms a portion of display device 130.

As also mentioned previously, a display device, such as device 130, may generate visual signals which appear to scroll upon the display screen of the display device by causing the display device to display successively a series of image frames in a manner analogous to the frames of a movie reel. Liquid crystal display device 130 of display circuit 100 of FIG. 1 is operative to permit scrolling of visual information by application of appropriate display signals on line 112 to controller chip 124. When display signal generator 106 comprises processor circuitry, algorithms executable by such processor circuitry are operative to cause generation on line 112 of the appropriate display signals to cause desired image frames to be displayed upon the display screen of display device 130 of display element 118.

Figure 2:
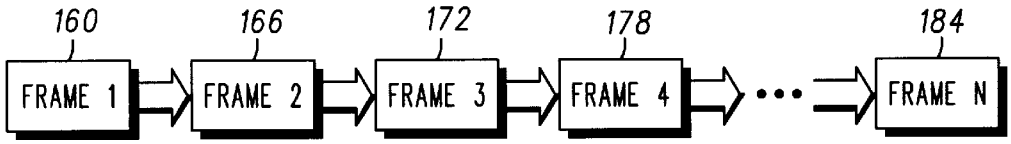
FIG. 2 is a representation of a sequence of image frames which are displayed upon the display screen of the display element of the display circuit of FIG. 1.

FIG. 2 is a representation of a sequence of image frames which are displayed upon the display screen of display device 130 of display circuit 100. The frames, here identified by reference numerals 160, 166, 172, 178, and 184 are representative of visual displays generated by display device 130. The visual displays are created responsive to application of display signals generated by display signal generator 106 on line 112 (and, more particularly, signals generated on line 136 responsive to the signals generated on line 112). Frames 160–184 illustrate visual images which, when displayed sequential by a display device, such device 130, form a scrolling display. By scrolling information upon the display device, information which would not otherwise fit upon the display device at any instant in time is made visible to a viewer within a short interval of time.

Figure 3:
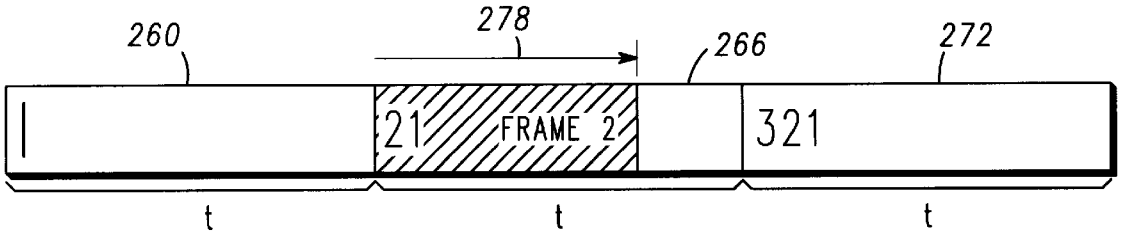
FIG. 3 is a representation of three adjacently-positioned image frames wherein the first image frame interferes with a significant portion of the second image frame.

Turning next to the representation of FIG. 3, three informational image frames, here indicated by reference numerals 260, 266, 272, are illustrated. (The term informational image frame and image frame shall, at times, be used interchangeably hereinbelow.) Frames 260–272 corresponds to three adjacently-positioned frames illustrated in FIG. 2, such as, for example frames 160–172. Frames 260–272 are also representative of visual images displayed upon a display device, such as liquid crystal display device 130 of display circuit 100 of FIG. 1. Each image frame 260–272 is generated for a time period, t, of similar durations. And, by displaying in a sequential manner each of the three frames, a scrolling effect of the visual information displayed by a display device is created. Alphanumeric information illustrated in each of the frames 260–272 is exemplary of a sequence of three image frames which, when displayed sequentially, scroll the digits 1, 2, and 3.

FIG. 3 further illustrates the effects of the image decay rate associated with a high-persistence device, such as liquid crystal display device 130 of display circuit 100. As also mentioned previously, a visual image generated by a high-persistence display device does not immediately disappear when signals which cause generation of such image are terminated. Rather, a time period, related to the image decay rate, is required prior to total disappearance of the image.

When successive image frames are sequentially generated for display upon such a high-persistence display device, interference of a previously-generated image frame is caused upon a subsequently-generated image frame as a result of the image decay rate associated with the high-persistence device. Shaded portions of second image frame 266 of FIG. 3 represents the time period during which the visual image of image frame 260, when displayed upon a high-persistence device interferes with a subsequently-generated image frame, here in image frame 266. Line segment 278 positioned above the shaded portion of image frame 266 is representative of the time period during which the image of image frame 260 interferes with the image of image frame 266. Such interference, also called runover, interferes with the resultant visual signal displayed by the display device displaying such sequence of image frames.

Interference between any two adjacently-positioned image frames may similarly be shown.

Figure 4:
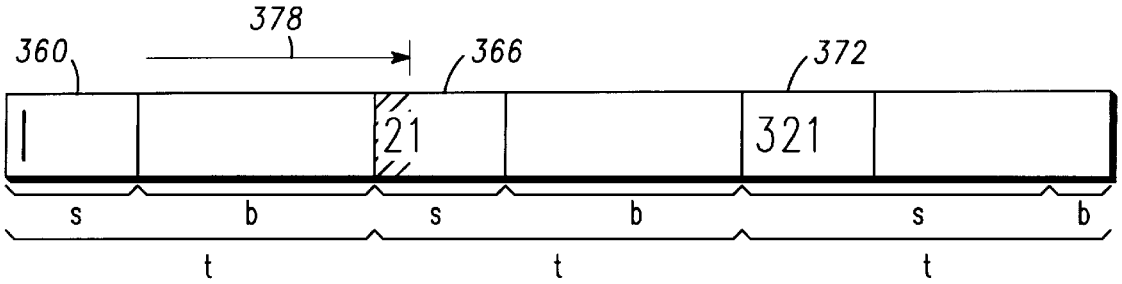
FIG. 4 is a representation, similar to that of FIG. 3, but of three adjacently-positioned image frames generated during operation of a preferred embodiment of the present invention in which interference between adjacently-positioned image frames is reduced.

FIG. 4 is a representation, similar to that of FIG. 3, which illustrates three image frames, here identified by reference numerals 360, 366, and 372, which may also be displayed by a display device, such as liquid crystal display device 130 of display circuit 100. The image frames represented in FIG. 4 are generated responsive to operation of a preferred embodiment of display circuit 100 wherein the deleterious effects resulting from the image decay rate of a high-persistence device are minimized.

While three image frames, 360, 366, and 372 are generated during a time period of 3t similar to the generation of three image frames 260, 266, and 272 during a corresponding time period in the representation of FIG. 3, interference between adjacently-positioned image frames in the representation of FIG. 4 is substantially reduced. Each image frame 360–372 is generated for a time period, s, which is a fractional portion of time period t. The image frames 360–372 are not generated during the remaining portions of time t; rather, during the remaining portion of time period t, identified by time period b, a blank image frame is generated. A blank image frame is an image frame which includes no information which, when displayed upon a display device, such as liquid crystal display device 130 of display circuit 100, results in a blank display.

The length of time during which the blank image frame is generated is related to the image decay rate of the display device upon which the image frames 360–372 are displayed. By terminating the generation of the informational image frames after time period s and thereafter generating blank image frames for the time period b, the amount of interference caused by a first-generated informational image frame upon a second-generated informational frame is reduced.

Arrow 378, corresponding to arrow 278 of FIG. 3, represents the time period associated with an image decay rate of a particular display device, such as liquid crystal display device 130 of display circuit 100 of FIG. 1. Because a second-generated informational image frame is generated only for a small portion of the time period corresponding to the image decay rate of the display device, the amount of interference between first- and second-generated informational image frames is significantly reduced. Of course, by reducing the time period s during which an informational image frame is generated, interference between informational frames may be further reduced.

Reduction in the time period s during which an informational image frame is generated cannot exceed a certain amount without introducing a flashing effect of the resultant visual signal generated by the display device which displays the sequences of image frames. (The term flashing effect refers to an on/off or blinking-like visual appearance of a visual signal formed by the display device.) That is to say, a reduction in the time period s during which the informational image frame is generated, thereby to reduce the amount of interference between successively-generated informational image frames, occurs only with a corresponding increase in the flashing effect. A balance between reduced interference and increased flashing effect must, accordingly be selected.

Figure 5:
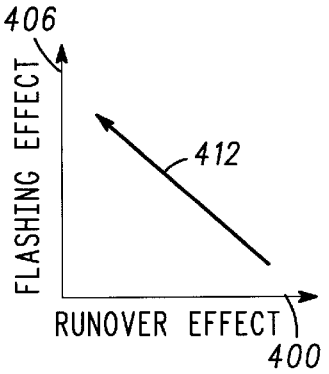
FIG. 5 is a graphical representation illustrating the relationship between interference of sequentially-generated image frames and the flashing effect exhibited during display of sequences of image frames displayed upon the display screen of the display element of the display circuit of FIG. 1.

FIG. 5 is a graphical representation which illustrates the relationship between such interference and such flashing effect. In the graphical representation of FIG. 5, interference between successively-generated informational image frames is plotted along abscissa axis 400 and levels of the flashing effect is plotted along ordinate axis 406. Curve 412 is a plot of the relationship between interference and flashing as the amount of interference decreases, the extent of the flashing effect increases, and as the amount of interference increases, the extent of the flashing effect decreases. The direction of the arrow of curve 412 represents a reduction in the time period s during which an informational image frame is generated.

Figure 6:
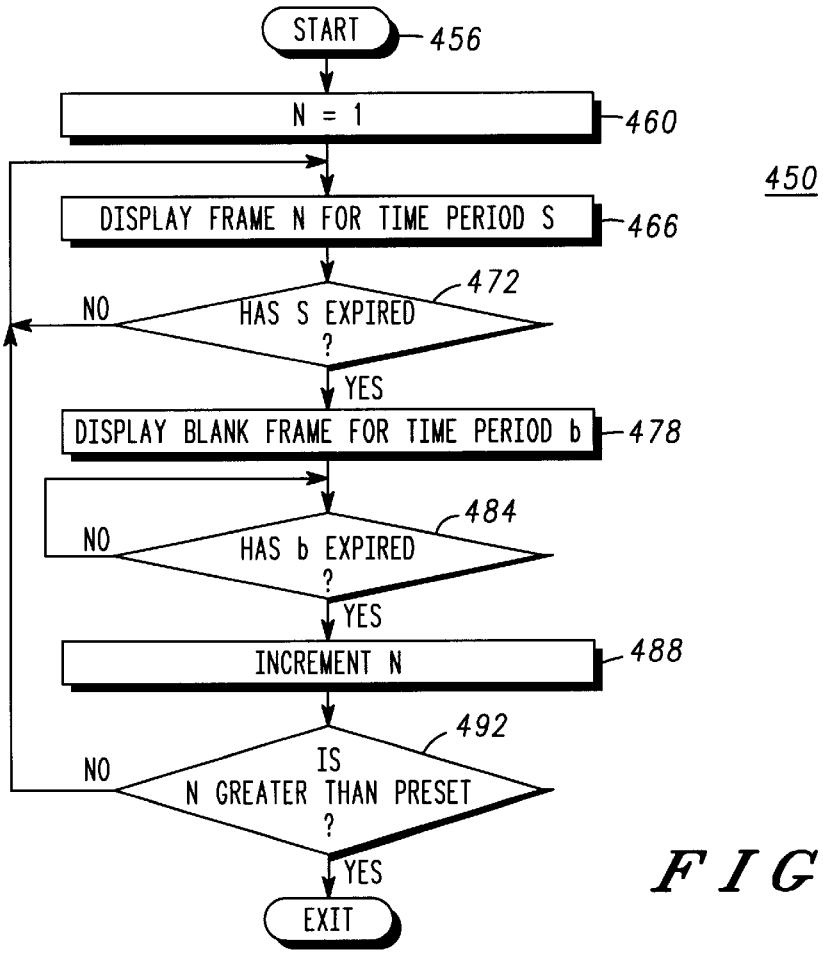
FIG. 6 is an algorithm executable by a processor forming a portion of the display circuit of FIG. 1 to minimize interference between sequentially-generated image frames to be displayed by the display element thereof.

FIG. 6 is a flow diagram, referred to generally by reference numeral 450, which is executable by processor circuitry comprising display signal generator 106 of display circuit of 100 of FIG. 1. The algorithm embodied by flow diagram 450 is operative to reduce the amount of interference between successively-generated informational image frames by interspersing blank image frames between adjacently-positioned, informational image frames.

After entry into the algorithm indicated by start block 456, a counter a set to one, as indicated by block 460.

Then, as indicated by block 466, frame N is displayed for a time period s. Next, and as indicated by decision block 472, a determination is made as to whether time period s has expired. If not, the no branch is taken, and frame N is continued to be displayed by the display device, such as display device 130 of FIG. 1. If the time period has expired the yes branch is taken and a blank image frame is displayed by the display device, as indicated by block 478, for a time period b.

Next, and as indicated by decision block 484, a determination is made as to whether time period b has expired. If not, the no branch is taken, and the blank image frame is continued to be displayed. If the time period has expired, the s branch is taken to block 488, whereat the counter is incremented. Then, as indicated by decision block 492, a determination is made as to whether the counter exceeds a preset value. If not, the no branch is taken, and a subsequent informational image frame is displayed. If the counter exceeds the preset value, the s branch is taken, and execution of the algorithm is terminated.

Figure 7:
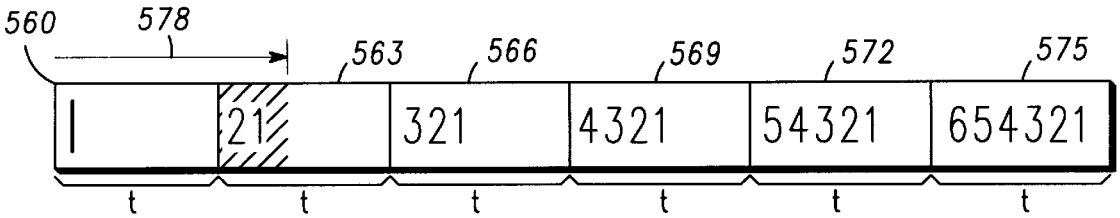
FIG. 7 is a representation of a series of sequentially-transmitted image frames which illustrates, in a manner similar to that of FIG. 3, interference between two adjacently-positioned image frames.

FIG. 7 is a representation, somewhat similar to the representation of FIG. 3, which illustrates a plurality of informational image frames, here indicated by reference numerals 560, 563, 566, 569, 572, and 575. Each of the image frames 560–575 is generated for a time period t. Similar to the representation of FIG. 3, interference caused by a first-generated image frame, here image frame 560, upon a second-generated image frame, here image frame 563, is indicated by shaded portions of frame 563, and arrow 578 is representative of an image decay rate associated with a display device, such as liquid crystal display 130 of display circuit 100 upon which the image frames are displayed.

Figure 8:
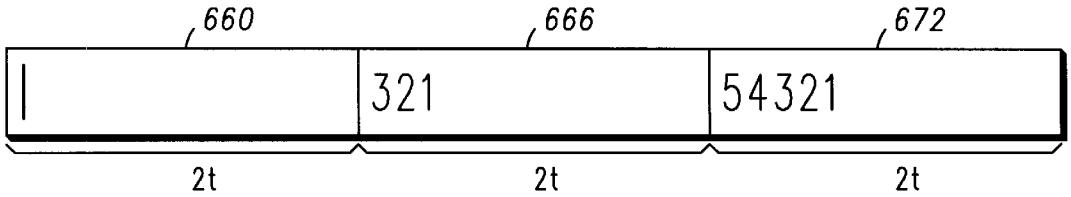
FIG. 8 is a representation, similar to that of FIG. 7, but illustrating a reduced number of image frames generated for display upon the display element of the display circuit of FIG. 1 during operation of a preferred embodiment of the present invention.

FIG. 8 is a representation, similar to that of FIG. 7, which again illustrates a series of informational image frames, here indicated by reference numerals 660, 666, and 672. Each image frame 660–672 is of a time period 2t. The time period during which each image frame 660–672 is generated is twice as great as the time period during which each of the image frames 560–575 of FIG. 7 is generated. The number of frames generated in the representation of FIG. 8 is, however, commensurately reduced, namely, also by a factor of two. The informational content of frame 560 corresponds to the informational content of frame 660, the informational content of frame 566 corresponds to the informational content of frame 666, and the informational content of frame 572 corresponds to the informational content of frame 672.

When frames 560–575 and frames 660–672 are displayed upon a display device, such as liquid crystal display device 130 of display circuit 100, at any time period of a multiple of time period 2t, the visual information displayed upon the display device is similar whether the sequence of image frames is that of 560–575 or that of image frames 660–472. Hence, by displaying image frames 660–672, the amount of time between display of successive ones of the image frame 660–672 is doubled while the perceived scrolling speed of the information displayed upon the display device remains constant. More generally, even though selected image frames are discarded, the same perceived scrolling speed may be maintained.

FIG. 9 is a representation which illustrates the advantageous utilization of display of smaller numbers of image frames without reducing the scrolling rate of the information displayed by a display device. FIG. 7 illustrates again informational image frames, here indicated by reference numerals 760, 766, and 772 which are generated for a time period, x, which is a fractional portion of time period t.

Interspersed between informational image frames 760–772 are blank image frames which are generated for time periods b, in a manner similar to the generation of blank image frames previously described with respect to FIG. 4. Because blank image frames are interspersed between adjacent ones of the informational image frames 760–772, interference between successive ones of the image frames when displayed upon a display device is minimized.

Because the time period between generation of successive ones of the informational image frames is a time period of 2t, rather than a time period of t, the time period during which a blank image frame and also an informational image frame may be generated is increased. Because a single informational image frame may be generated for a period of time, x, greater than the period of time, s, during which an image frame was generated with respect to the description of FIG. 4, the flashing effect noted hereinabove may be reduced while still minimizing interference between successively-generated informational frames.

In the description of FIGS. 7–9, alternating ones of the informational image frames are discarded, thereby to increase the time period during which a single informational image is displayed without reducing the perceived scrolling rate of information displayed upon a display device. And, the illustrated example was one in which time period t is of a value less than a time period associated with the image decay rate, D, of a display device which, in turn, is less than the time period 2t.

More generally, (n−1) informational image frames may be discarded where n is defined to be an integer quantity of the ratio D/t.

For instance, if the time period t during which an informational image is to be displayed is one-fifth of the time period D of the image decay rate, the value of n is 5, only one out of five informational displays is required to be displayed, and the four intervening informational image displays may be discarded.

As a result, the perceived rate of scrolling of information comprised of the informational image frames is not reduced, and blank image frames may be interspersed between the informational image frames to minimize interference between successively-generated image frames.

However, by discarding informational image frames, a jumping effect is introduced into the visual signal displayed by the display device. Such jumping effect is analogous to the choppy-appearance of the movement of characters in antiquated movie reels in which insufficient numbers of picture frames are utilized to form such reels.

Accordingly, a balance must be formed between the numbers of discarded informational image frames to minimize the interference between successive one of the informational image frames and the jumping effect occurring as a result of such discarding of informational image frames.

FIG. 10 is a graphical representation which illustrates the relationship between interference between a first-generated informational image frame upon a subsequently-generated, informational image frame and the resultant increase in the jumping effect. The amount of interference is scaled along abscissa axis 800, and the extent of the jumping effect is scaled along ordinate axis 806. Curve 812 represents the relationship between the interference and the extent of the jumping effect. By discarding increased numbers of informational image frames, the extent of the jumping effect increases, while discarding fewer numbers of informational image frames results in a lesser extent of the jumping effect, albeit while resulting in increased interference between the successively-generated, image frames. The direction of the arrow of curve 812 represents increase in the reduction of numbers of informational image frames.

FIG. 11 is a block diagram of a radiotelephone, referred to generally by reference numeral 996, which includes a display circuit 1000 similar to display circuit 100 of FIG. 1, as a portion thereof.

Display circuit 1000 of radiotelephone 996 is shown to include processor 1006 comprising, as a portion thereof, a display signal generator which generates display signals on line 1012. Display element 1018 is coupled to receive the display signals generated on line 1012 by processor 1006. Operative in a manner analogous to display element 118 in FIG. 1, display element 1018 is operative to generate upon a display screen of the display element visual signals corresponding to the display signals generated on line 1012 by processor 1006. The display signals generated by processor 1006 correspond to selected informational image frames having blank image frames interspersed therebetween.

Display element 1018 is thereby operative to display upon the display screen thereof information which appears to scroll across the display screen while minimizing interference between successive ones of the informational image frames. Proper selection of the parameters of algorithms executable by processor 1006 permit a proper balance to minimize interference between such successive image frames displayed by display elements while also minimizing the extent of the jumping and flashing effect of the visual signals displayed upon the display screen of display element 1018.

Radiotelephone 996 is further shown to include transceiver circuitry 1050 having both a transmitter circuitry portion and a receiver circuitry portion which are connected to processor 1006 by way of line 1056. In the preferred embodiment of the present invention, processor 1006 is further operative to control operation of transceiver circuitry 1050.

Input element 1062 further forms a portion of radio telephone 996. Input element 1062 is connected to processor 1006 by way of line 1068. Input element 1062 may include, for example, actuation keys including the actuation keys of a conventional telephonic keypad. Actuation of selected ones of the actuation keys comprising input element 1062 provide inputs to processor 1006 to control operation of transceiver circuitry 1050. Processor 1006 may, of course, be made operative to generate display signals on line 1012 of values responsive to the actuation of actuation keys of input element 1062. Processor 1006 may also similarly be made to be operative to generate display signals on line 1012 responsive to operation of transceiver circuitry 1050.

Because blank image frames are introduced between informational image frames which are displayed upon the display screen of display element 1018, interference between successive ones of the informational image frames displayed upon the display screen of display element 1018.

It should be noted, of course, that display circuit 100 of FIG. 1 may similarly be utilized to form a portion of any of many other electronic devices which include a high-persistence display device as a portion thereof.

Turning finally now to the logical flow diagram of FIG. 11, the method steps of a method, referred to generally by reference numeral 1100, of a preferred embodiment of the present invention are listed. Method 1100 is operative to display visually a sequence of at least two informational frames upon a display screen of a display element.

First, and as indicated by block 1106, display signals are generated which cause the display element to display upon the display screen informational image frames corresponding to values of the display signals. The display signals are of signal values including at least signal values corresponding to a first of the at least two informational image frames, a second of the at least two informational image frames, and a blank image frame.

Next, and as indicated by block 1106, signal values corresponding to the blank image frame are interspersed between the signal values corresponding to the first and second informational image frames. The signal values corresponding to the blank image frame are generated for a time period to reduce interference on the display screen of the first informational image frame upon the second informational image frame.

While the present invention has been described in connection with the preferred embodiments shown in the various figures, it is to be understood that other similar embodiments may be used and modifications and additions may be made to the described embodiments for performing the same functions of the present invention without deviating therefrom. Therefore, the present invention should not be limited to any single embodiment, but rather construed in breadth and scope in accordance with the recitation of the appended claims.

What is claimed is:

1. A display circuit for scrolling information image frames across a display area having a first end and a second end such that message images move across the display area, the first and second ends on opposite ends of the display area, the display circuit comprising:

a liquid crystal display element having a persistent display screen including the display area to display the information image frames thereupon, the persistent display screen having an associated image decay rate;

a display signal generator coupled to the display element to generate display signals which cause the display element to sequentially display in the display area a plurality of information image frames which are periodically moved a predetermined distance from the first end toward the second end during blank intervals, the display signal generator generating display signals which do not control the display element to display an information image during the blank interval, the blank interval being proportional to the decay rate of the display screen such that each information image fades substantially from the display area before the information image is moved to reduce interference between information image frames; and a liquid crystal display device controller coupled to the display signal generator to receive the display signal generated by the display signal generator and to generate control signals to power at least selected portions of the liquid crystal display element responsive to the display signal.

2. The display circuit of claim 1 wherein the display signal generator comprises processor circuitry having an algorithm stored and executable therein, wherein execution of the algorithm causes the processor circuitry to generate the display signals of selected signal values.

3. The display circuit of claim 2 wherein the display signal generator further comprises means for determining the number of informational image frames comprising the sequence of information image frames to be scrolled across the display area.

4. The display circuit of claim 3 wherein the sequence of the at least two information image frames comprises at least a first information image frame and a second information image frame, and wherein the display signal generator is further operative to substitute blank image frames for a portion of the signal values corresponding to the first information image frame preceding application of the second image frame.

5. The display circuit of claim 4 wherein the display signals of the signal values other than the signal values corresponding to the second information image frame generated by the display signal generator in substitution for the signal values corresponding to the second information image frame comprise signal values corresponding to the blank frame interspersed between the first and second image frames, thereby to increase the time period during which the display element generates the blank frame.

6. The display circuit of claim 5 wherein the display signal of the signal values other than the signal values corresponding to the second information image frame further comprise signal values corresponding to the first information image frame.

7. The display circuit of claim 6 wherein the sequence of at least two information image frames comprises a plurality of information image frames and wherein the display signal generator is further operative to substitute blank interval signal values for signal values corresponding to selected ones of the plurality of information image frames.

8. The display circuit of claim 7 wherein the number of image frames for which the signal values corresponding to the blank frame are substituted is proportional to a ratio of the image decay rate and time periods associated with the informational image frames.

9. A method scrolling a sequence of information image frames across a display area of a display screen of an LCD display element, the display element having an image decay rate, said method comprising the steps of:

a) generating a display signal which causes the display element to display upon the display area of the display screen a first information image which is at least a portion of a message to be displayed in the display area;

b) generating a display signal value corresponding to a blank image frame which does not control the display element to display an information image in the display area for a time period proportional to the image decay rate of the display screen to reduce interference on the display screen of the first information image with a subsequent information image;

c) generating a display signal which causes the display element to display upon the display area of the display screen another information image which includes at least a portion of the first information image shifted in the display area at least a predetermined amount, to display another portion of the message to be displayed in the display area; and d) repeating steps b and c until the entire message has been displayed in the display area.

10. The method of claim 9 comprising the additional steps of:

determining the number of information image frames comprising the entire image; and substituting signal values corresponding to the blank frame for signal values corresponding to selected information image frames of the sequence of informational image frames.

11. The method of claim 10 wherein the time period during which the signal values corresponding to the blank frame are substituted for signal values corresponding to selected information image frames during the step of substituting is directly related to the image decay rate of the display element.

* * * * *